US010413806B1

(12) United States Patent
Kuo

(10) Patent No.: US 10,413,806 B1
(45) Date of Patent: Sep. 17, 2019

(54) CUE BUTT WITH BALL CONTROL ENHANCEMENT FUNCTION AND BILLIARD CUE THEREOF

(71) Applicant: Hamson Global Co., Ltd, Taichung (TW)

(72) Inventor: Shan-Huei Kuo, Taichung (TW)

(73) Assignee: HAMSON GLOBAL CO., LTD, Taichung (TW)

( * ) Notice: Subject to any disclaimer, the term of this patent is extended or adjusted under 35 U.S.C. 154(b) by 0 days.

(21) Appl. No.: 15/969,528

(22) Filed: May 2, 2018

(51) Int. Cl.
*A63D 15/08* (2006.01)

(52) U.S. Cl.
CPC ..... *A63D 15/08* (2013.01)

(58) Field of Classification Search
CPC ..... A63D 15/08; A63B 69/00
See application file for complete search history.

(56) References Cited

U.S. PATENT DOCUMENTS

| | | | | |
|---|---|---|---|---|
| 3,968,965 | A * | 7/1976 | Frenkel | A63B 49/08 473/531 |
| 2003/0166419 | A1* | 9/2003 | Gulyassy | A63D 15/08 473/44 |
| 2008/0318698 | A1* | 12/2008 | Wynn | A63D 15/08 473/44 |
| 2015/0111671 | A1* | 4/2015 | Blankenship | A63B 15/00 473/457 |

* cited by examiner

*Primary Examiner* — Eugene L Kim
*Assistant Examiner* — Christopher A Glenn
(74) *Attorney, Agent, or Firm* — Muncy, Geissler, Olds & Lowe, P.C.

(57) ABSTRACT

A cue butt with ball control enhancement function and a billiard cue thereof are disclosed. The cue butt is combined with a cue shaft of the billiard cue. The cue butt includes a core rod and an external body mounted around an outer edge of the core rod, wherein the external body includes a plurality of strip shaped casing members disposed around a central axis of the core rod. With such configuration, the stability of ball control during the billiard sport is improved.

9 Claims, 23 Drawing Sheets

CUE BUTT WITH BALL CONTROL ENHANCEMENT FUNCTION AND BILLIARD CUE THEREOF

BACKGROUND OF THE INVENTION

1. Field of the Invention

The present invention relates to billiard cues, and more particularly, to a cue butt with ball control enhancement function and billiard cue thereof.

2. Description of the Related Art

A conventional billiard cue is usually formed of a cue shaft and a cue butt, so as to facilitate the mobility of the billiard cue.

The billiard cue is generally made of wood material.

However, the fiber orientation of the wood may not be averagely arranged. Also, a tree may grows in different directions due to the phototropism and negative phototropism of plant, so that the wood qualities of different trees differ from each other. As a result, the manufactured billiard cues may not achieve a consistent cue ball controlling effect. In addition, because wood material includes different texture and capillary bores, such that quality of the cue butt is easily affected by the varying weather, failing to maintain the quality consistency.

For resolving such issues, some billiard cues in the market are made of composite material of carbon fiber, so as to prevent the deformation of the billiard cue from happening. However, the rigidity of such billiard cue is larger than the rigidity of wooden billiard cue, causing the difficulty of cue ball controlling by such billiard cues.

SUMMARY OF THE INVENTION

For improving the issues above, an embodiment of the present invention discloses a cue butt with ball control enhancement function and billiard cue thereof. The cue butt is made of a composition of components, instead of being made of a single structure, so as to achieve a more stable cue ball controlling effect.

For achieving the aforementioned objectives, a cue butt with ball control enhancement function in accordance with an embodiment of the present invention is provided for being combined with a cue shaft. The cue butt comprises a core rod and an external body.

The external body is mounted around an outer edge of the core rod, wherein the external body includes a plurality of strip shaped casing members disposed around a central axis of the core rod.

In an embodiment of the present invention, an extension rod is connected between the cue shaft and the cue butt.

In an embodiment of the present invention, the core rod is a single solid structure which is allowed to be formed of a singular component or combined by multiple components.

In an embodiment of the present invention, the sectional face of the core rod is formed in a circular shape, and the shape of the inner edge of the external body fits the shape of the sectional face of the core rod.

In an embodiment of the present invention, the sectional face of the core rod is formed in a non-circular shape, and the shape of the inner edge of the external body fits with the shape of the sectional face of the core rod.

In an embodiment of the present invention, a hollow member is mounted around the core rod, such that the hollow member is disposed between the outer edge of the core rod and the external body.

In an embodiment of the present invention, the hollow member is a multi-layer structure, such that the hollow body is formed of a material chosen from a group consisting of wood, carbon fiber, bakelite, or a combination thereof.

In an embodiment of the present invention, the outer edge of the core rod and the inner edge of the hollow member are allowed to be correspondingly formed in a circular or non-circular shape. Also, the outer edge of the hollow member is allowed to be formed in a circular or non-circular shape and the shape of the inner edge of the external body fits the shape of the outer edge of the hollow member.

In an embodiment of the present invention, an even amount of casing members are included.

In an embodiment of the present invention, a billiard cue is provided, comprising a cue shaft which is combined with the cue butt, wherein the cue shaft includes a first combination portion, and the cue butt includes a second combination portion, such that the first combination portion and the second combination portion are combined through a concave-convex structure.

In an embodiment of the present invention, the first combination portion and the second combination portion are screwedly combined.

With such configuration, the cue butt provided by the present invention is a combination structure instead of a singular component, so as to prevent the overall quality of the billiard cue from being affected by the weather variation. Also, the structure of such billiard cue is not rigid beyond a desired degree, facilitating the ball control effect and optimizing the ball hitting performance during a billiard sport.

DETAILED DESCRIPTION OF THE INVENTION

The aforementioned and further advantages and features of the present invention will be understood by reference to the description of the preferred embodiment in conjunction with the accompanying drawings where the components are illustrated based on a proportion for explanation but not subject to the actual component proportion.

The text "inner edge" cited herein refers to an outline disposed around the central axis of a rod or tube shaped component for defining the inner wall of the rod or tube shaped component in a sectional view of the component. The text "outer edge" cited herein refers to an outline disposed around the central axis of a rod or tube shaped component for defining the outer wall of the rod or tube shaped component in a sectional view of the component.

Figure 1:
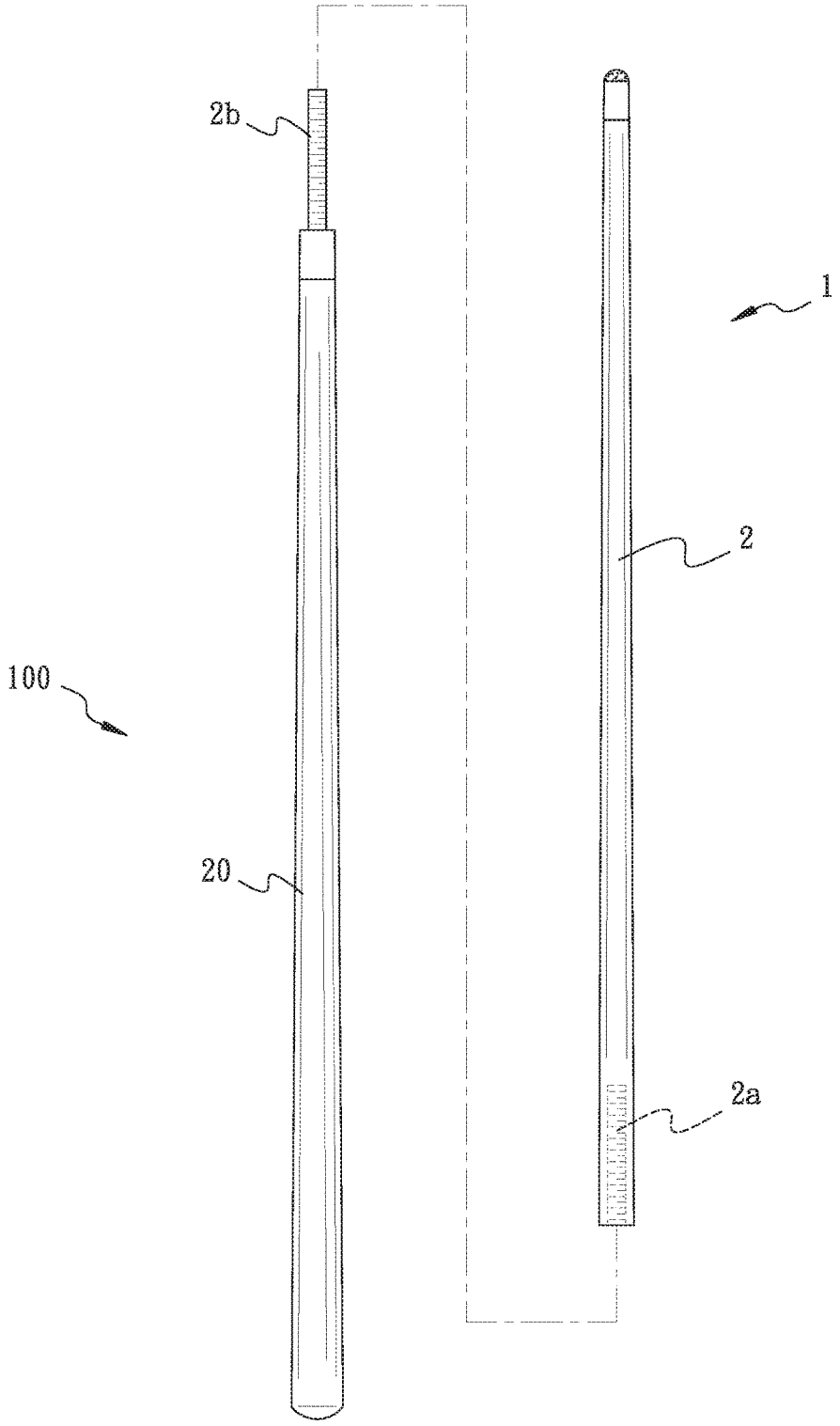
FIG. 1 is an exploded view of the billiard cue in accordance with an embodiment of the present invention.
Figure 2A:
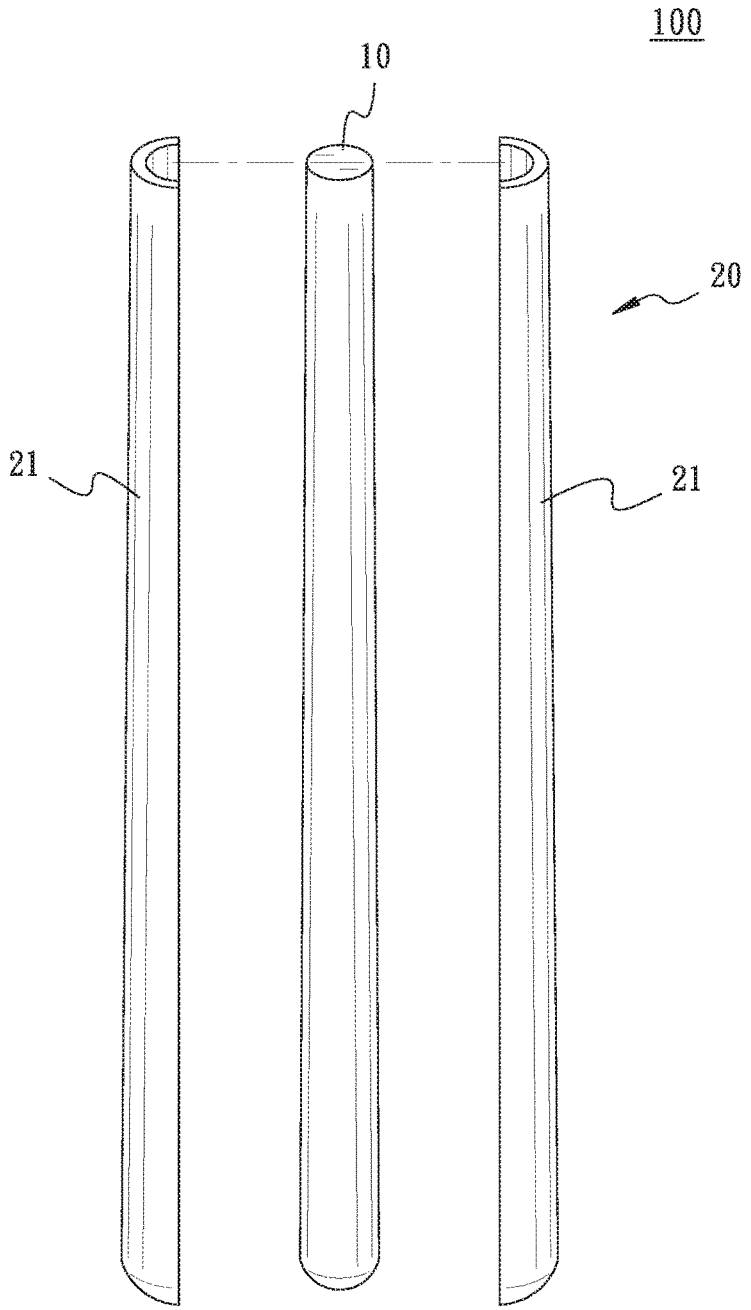
FIG. 2A is an exploded view of the cue butt in accordance with the first embodiment of the present invention.
Figure 2B:
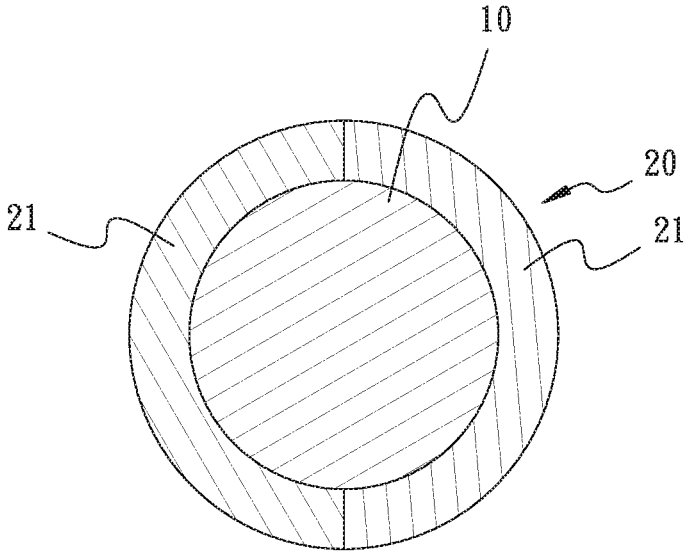
FIG. 2B is a sectional view of the cue butt in accordance with the first embodiment of the present invention.

Referring to FIG. 1, FIG. 2A, and FIG. 2B, a cue butt 100 with ball control enhancement function in accordance with a first embodiment of the present invention is provided, which is combined with a cue shaft 2 of a billiard cue 1. The cue butt 100 comprises a core rod 10 and an external body 20. The cue shaft 2 includes a first combination portion 2*a*, and the cue butt 100 includes a second combination portion 2*b*, such that the first combination portion 2*a* and the second combination portion 2*b* are combined through a concave-convex structure into the billiard cue 1. In an embodiment of the present invention, the first combination portion 2*a* and the second combination portion 2*b* are screwedly combined.

The core rod 10 is a singular solid structure made of wood, non-wood, or composite material, wherein the non-wood material is chosen from carbon fiber, fiberglass, aluminum, or iron. In an embodiment of the present invention, the core rod 10 has a first end and a second end, with an outer edge formed along an axial direction between the first end and the second end, wherein the outer edge is shaped in a continuous smooth surface without concave and convex structures.

Figure 3A:
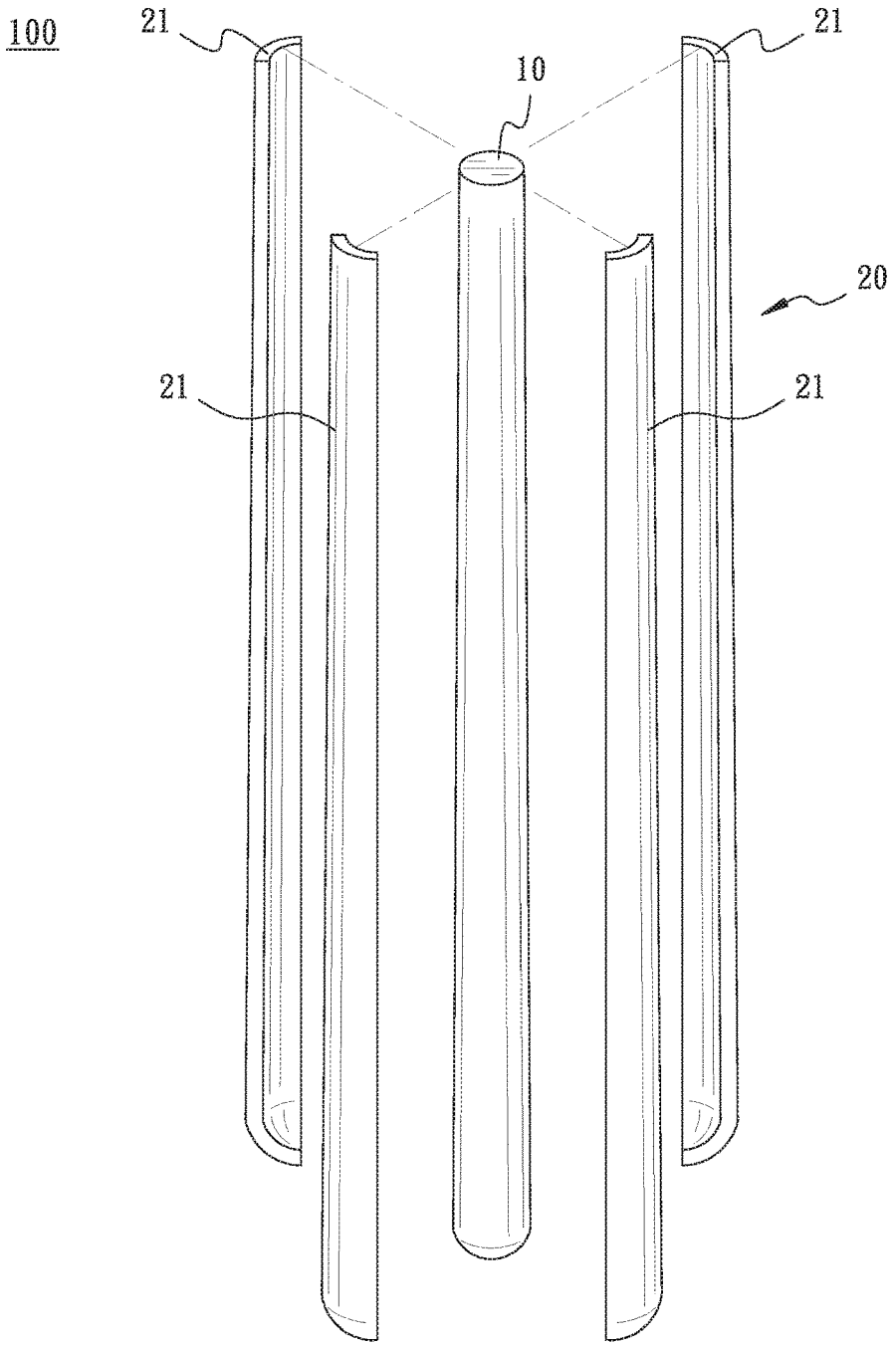
FIG. 3A is an exploded view of the cue butt in accordance with the second embodiment of the present invention.
Figure 3B:
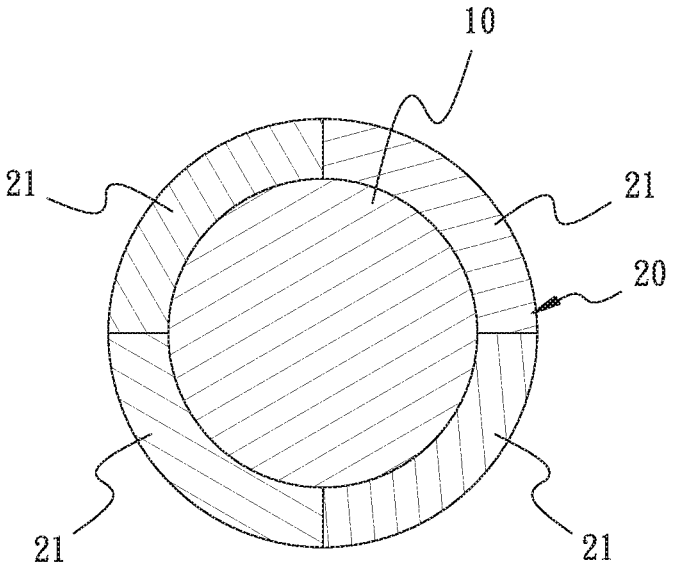
FIG. 3B is a sectional view of the cut butt in accordance with the second embodiment of the present invention.

The external body 20 is a made of wood, non-wood, or composite material, wherein the non-wood material is chosen from carbon fiber, fiberglass, aluminum, or iron. The external body 20 is mounted around and fully covers the outer edge of the core rod 10. The external body 20 includes a plurality of strip shaped casing members 21 disposed around a central axis of the core rod 10, so as to cover the core rod 10 by a non-integrally formed structure of the external body 20. Each of the casing members 21 has an inner surface which is formed in a continuous smooth surface without concave and convex structures corresponding to the outer edge. In an embodiment of the present invention, the sectional face of the core rod 10 is formed in a circular shape, and the inner edge of the external body 20 is correspondingly formed in a circular shape for fitting the core rod 10. Also, the casing members 21 are provided in an even amount, such as two casing members 21 having a semi-circularly shaped sectional face. Therefore, the cue butt 100 in accordance with an embodiment of the present invention is formed of a combination structure instead of a singular component, so as to prevent the overall quality of the billiard cue 1 from being affected by the weather variation. Also, the structure of such billiard cue 1 is not overly rigid beyond a desired degree, thus facilitating the ball control effect and optimizing the ball hitting performance during a billiard sport. In a second embodiment shown in FIGS. 3A and 3B, the external body 20 is formed of four casing members 21 with the sectional face of each casing member 21 formed in a quarter circle shape.

Figure 4A:
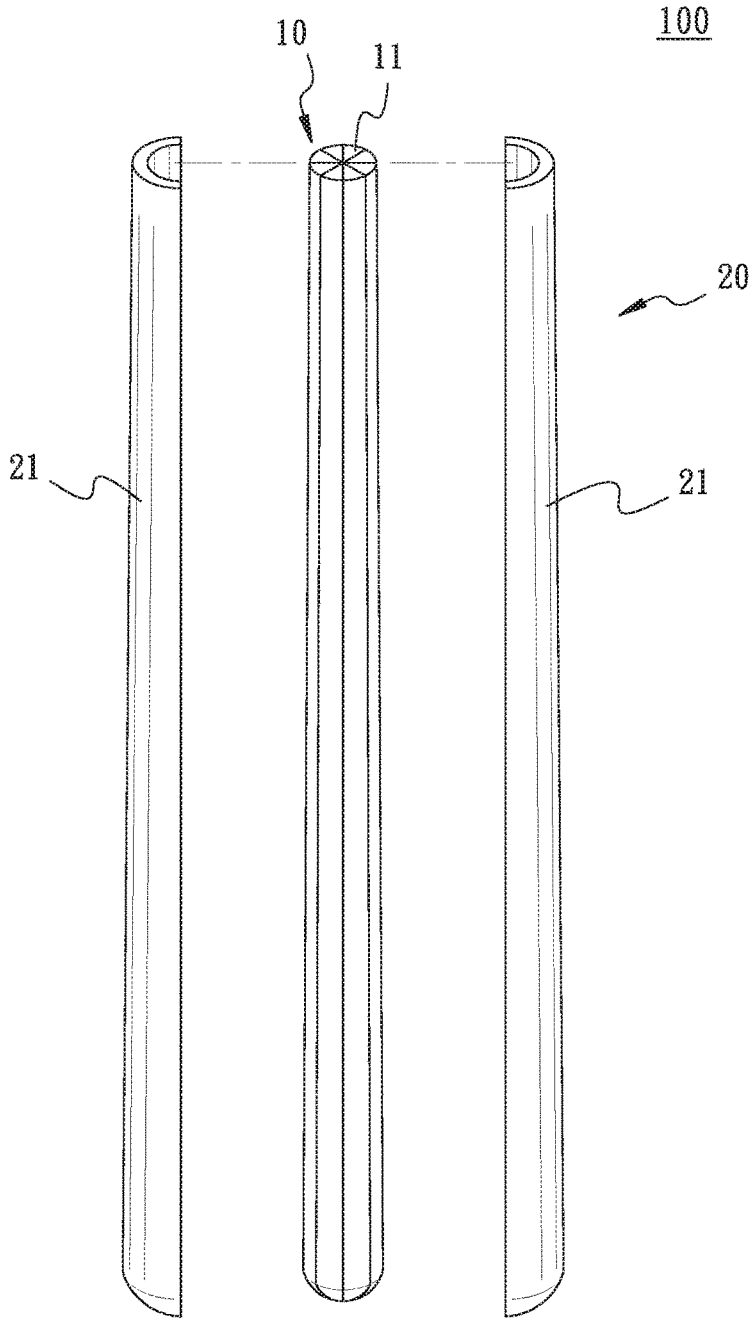
FIG. 4A is an exploded view of the cue butt in accordance with the third embodiment of the present invention.
Figure 4B:
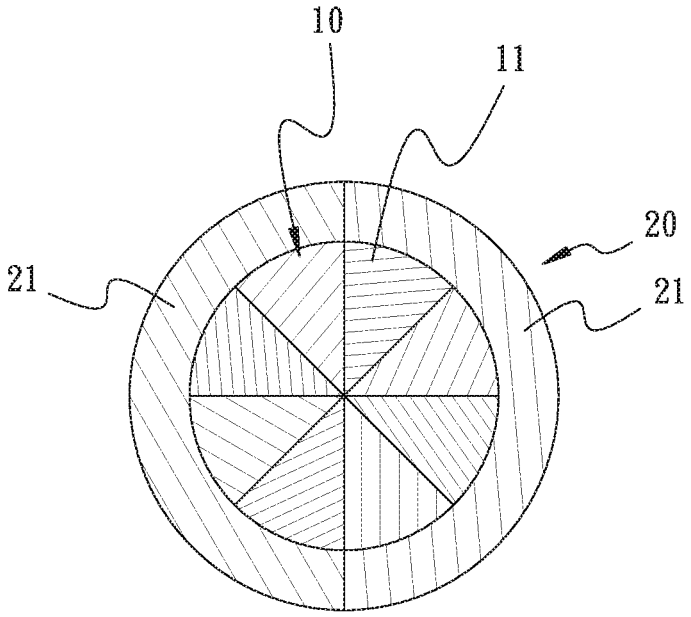
FIG. 4B is a sectional view of the cut butt in accordance with the third embodiment of the present invention.
Figure 5A:
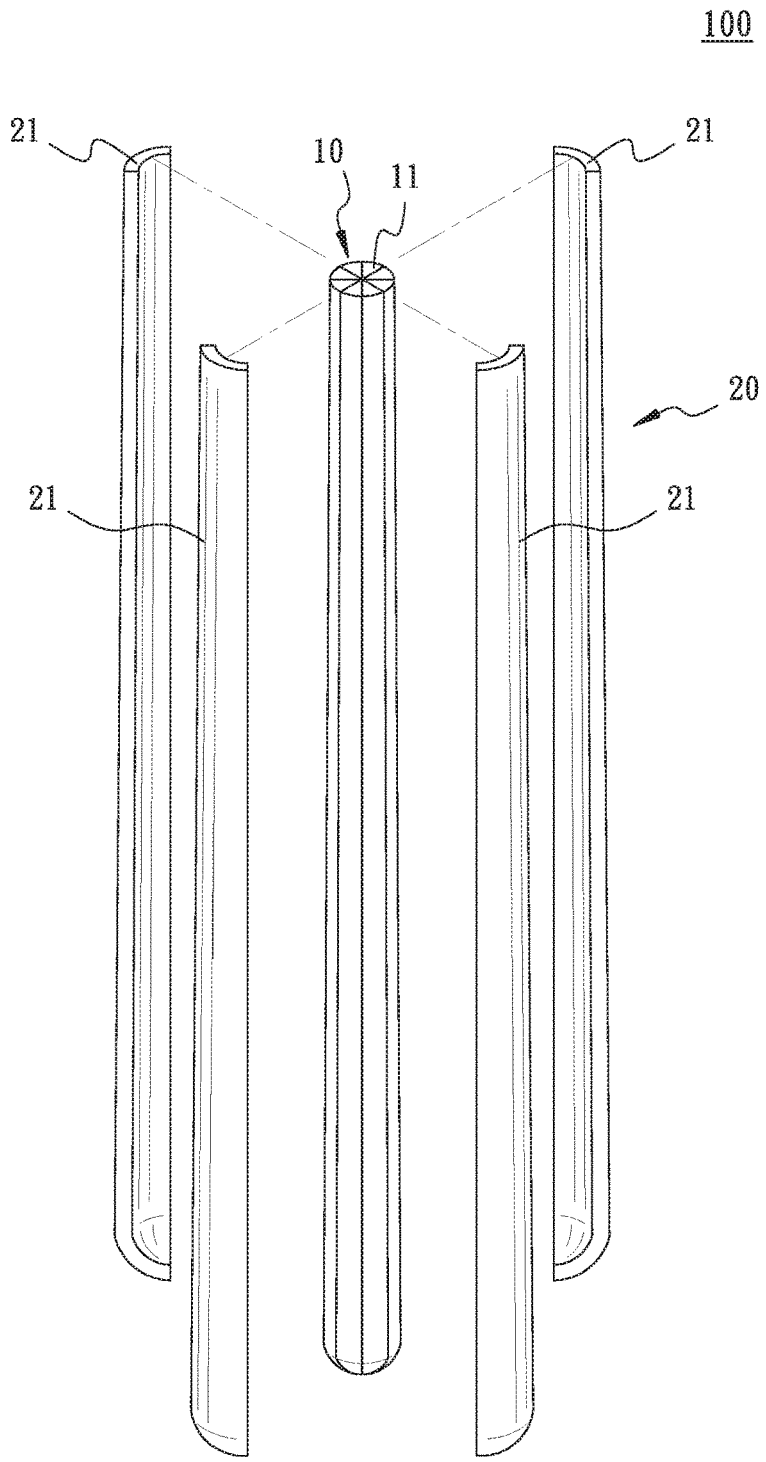
FIG. 5A is an exploded view of the cue butt in accordance with the fourth embodiment of the present invention.
Figure 5B:
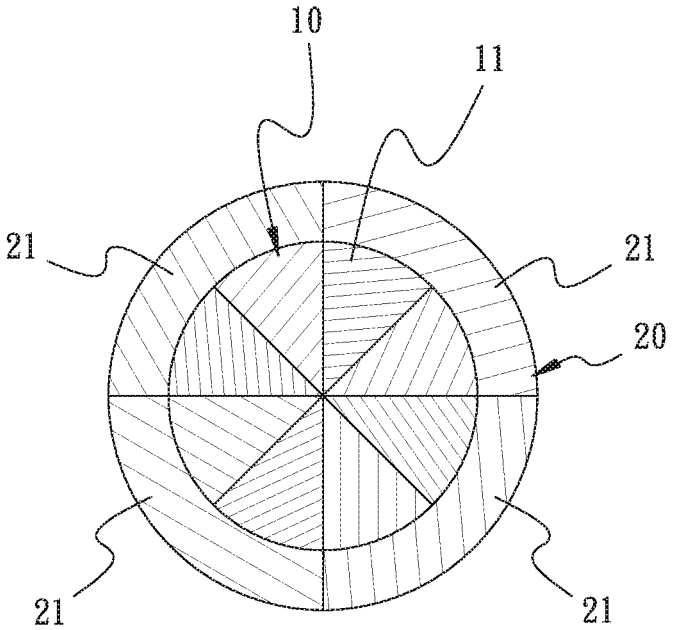
FIG. 5B is a sectional view of the cut butt in accordance with the fourth embodiment of the present invention.

Referring to FIG. 4A and FIG. 4B, a cue butt 100 with ball control enhancement function in accordance with a third embodiment of the present invention is provided. The core rod 10 is a solid structure formed of a plurality of component members 11. The sectional face of the solid structure is formed in an approximate circular shape, and the external body 20 includes two casing members 21 whose sectional face is formed in a semi-circular shape. Referring to the fourth embodiment as shown in FIG. 5A and FIG. 5B, the external body 20 includes four casing member 21 whose sectional face is formed in a quarter circular shape.

Figure 6:
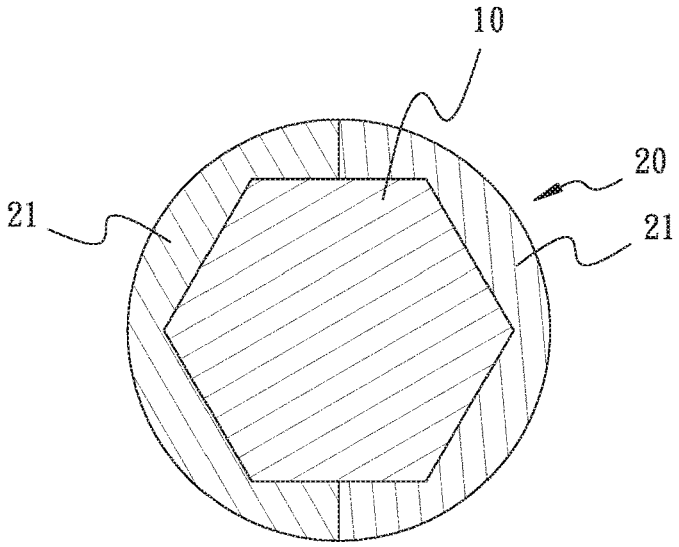
FIG. 6 is a sectional view of the cut butt in accordance with the fifth embodiment of the present invention.
Figure 7:
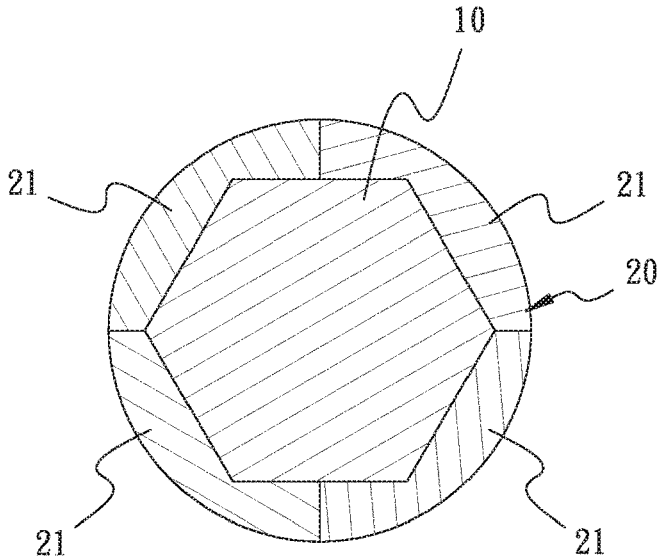
FIG. 7 is a sectional view of the cut butt in accordance with the sixth embodiment of the present invention.

Referring to FIG. 6, a cue butt 100 with ball control enhancement function in accordance with a fifth embodiment of the present invention is provided. The sectional face of the solid core rod 10 is formed in a non-circular shape, such as a hexagonal shape, with the inner edge of the external body 20 formed in a shape corresponding to the shape of the sectional face of the core rod 10. Also, the external body 20 includes an even amount of the casing members 21, such as an amount of two. Referring to the sixth embodiment as shown in FIG. 7, the external body 20 includes four casing members 21.

Figure 8:
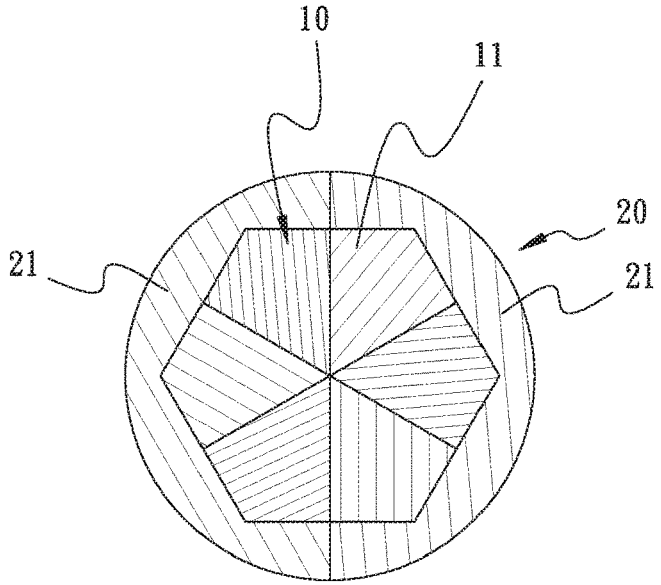
FIG. 8 is a sectional view of the cut butt in accordance with the seventh embodiment of the present invention.
Figure 9:
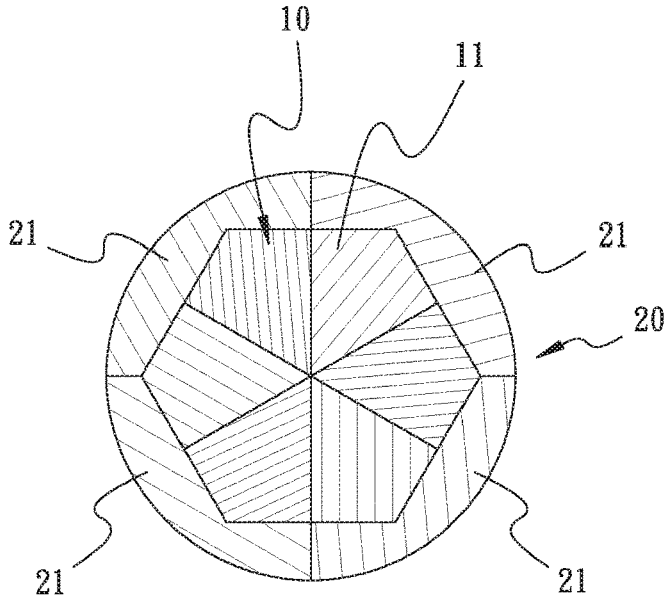
FIG. 9 is a sectional view of the cut butt in accordance with the eighth embodiment of the present invention.

Referring to FIG. 8, a cue butt 100 with ball control enhancement function in accordance with a seventh embodiment of the present invention is provided. The core rod 10 is a solid structure formed of a plurality of component members 11, wherein the sectional face of the core rod 10 is formed in a non-circular shape, such as a hexagonal shape. The external body 20 includes two casing members 21. Referring to the eighth embodiment as shown in FIG. 9, the external body 20 includes four casing members 21.

Figure 10A:
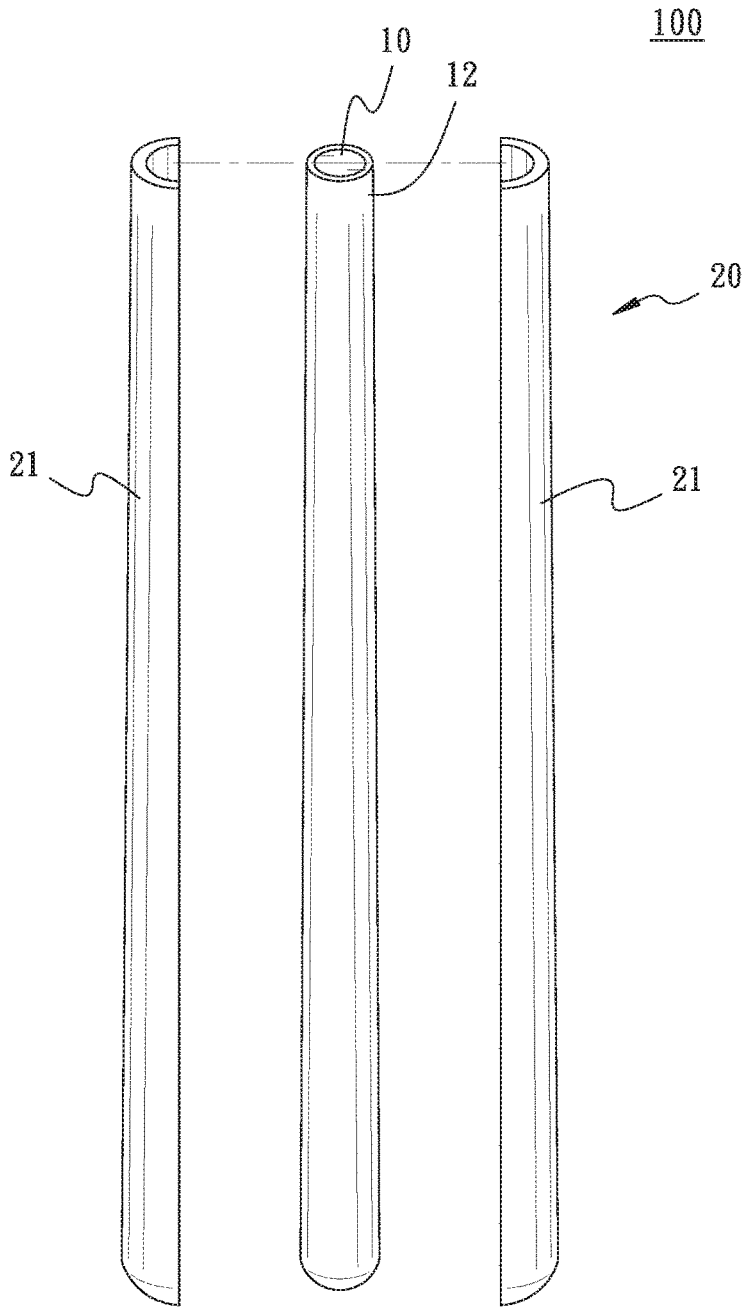
FIG. 10A is an exploded view of the cue butt in accordance with the ninth embodiment of the present invention.
Figure 10B:
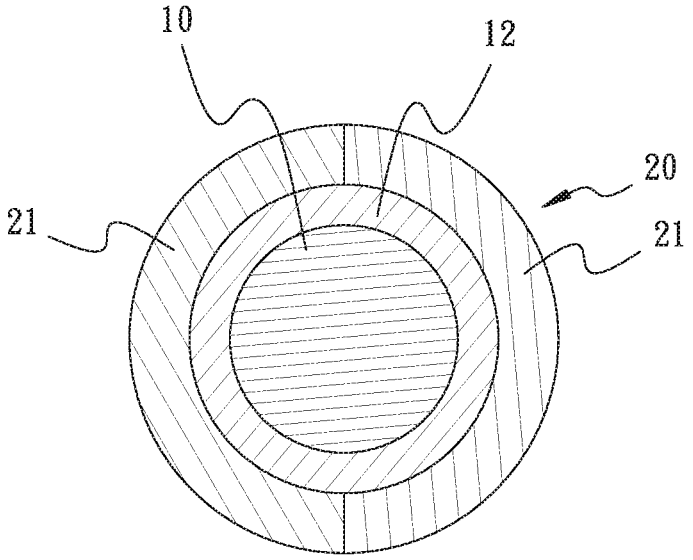
FIG. 10B is a sectional view of the cut butt in accordance with the ninth embodiment of the present invention.

Referring to FIG. 10A and FIG. 10B, a cue butt 100 with ball control enhancement function in accordance with a ninth embodiment of the present invention is provided. The core rod 10 is a singular solid structure, and the external body 20 includes two casing members 21 whose sectional face is formed in a semi-circular shape. In addition, a hollow member 12, which is formed of a material chosen from wood, non-wood, or composite material, is further included to be mounted around an outer edge of the core rod 10, such that the hollow member 12 seamlessly covers the outer edge of the core rod 10 and is disposed between the core rod 10 and the external body 20. Also, the hollow member 12 has an outer surface formed in a continuous smooth surface without concave and convex structures, such that the inner surface of the casing member 21 is seamlessly attached to the outer surface. Due to the seamless attachment among between the core rod 10, the hollow member 12, and the casing member 20, the overall structure is compact, facilitating the ball hitting performance and being favorable for the assembling and manufacturing processes. In addition, the outer edge of the core rod 10 and the inner edge of the hollow member 12 are formed in a corresponding circular shape for facilitating the fitting engagement therebetween. The outer edge of the hollow member 12 is formed in a circular shape, with the inner edge of the external body 20 formed in a corresponding shape for facilitating the fitting engagement therebetween.

Figure 11A:
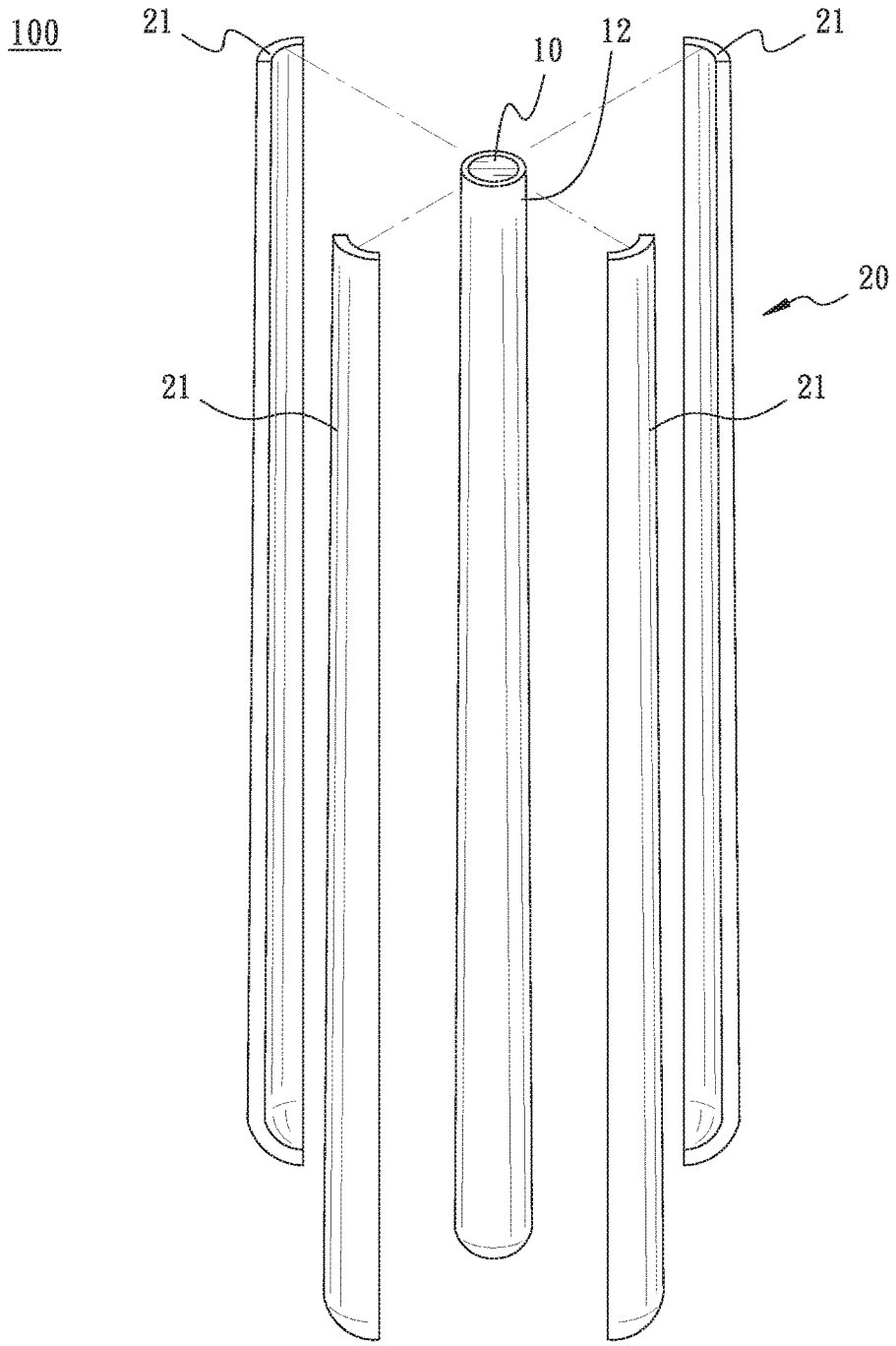
FIG. 11A is an exploded view of the cue butt in accordance with the tenth embodiment of the present invention.
Figure 11B:
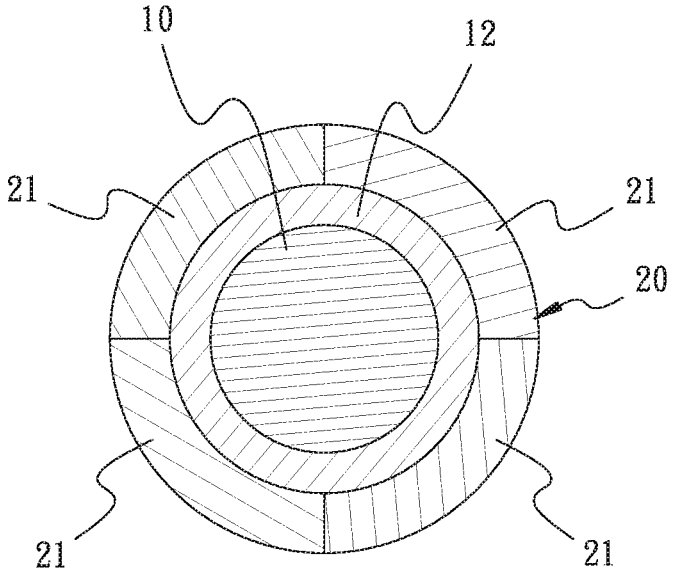
FIG. 11B is a sectional view of the cut butt in accordance with the tenth embodiment of the present invention.

Referring to the tenth embodiment as shown in FIG. 11A and FIG. 11B, the external body 20 includes four casing members 21 whose sectional face is formed in a quarter circular shape.

Figure 12A:
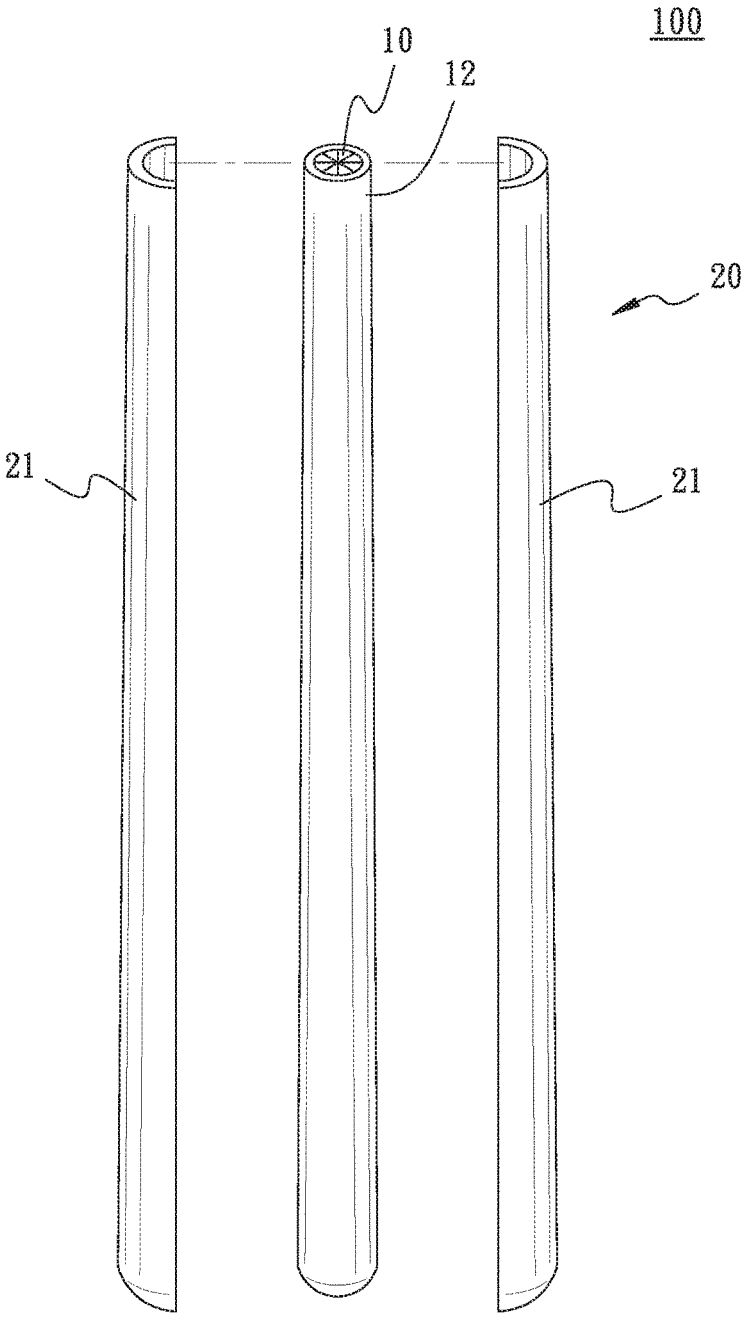
FIG. 12A is an exploded view of the cue butt in accordance with the eleventh embodiment of the present invention.
Figure 12B:
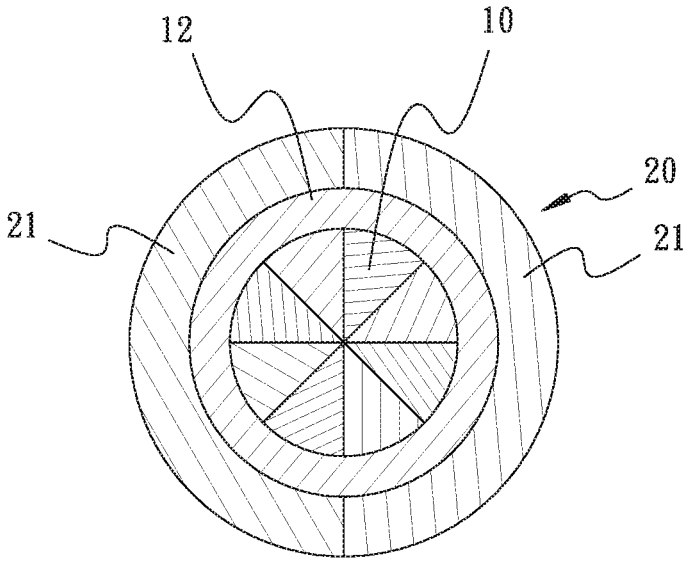
FIG. 12B is a sectional view of the cut butt in accordance with the eleventh embodiment of the present invention.
Figure 13A:
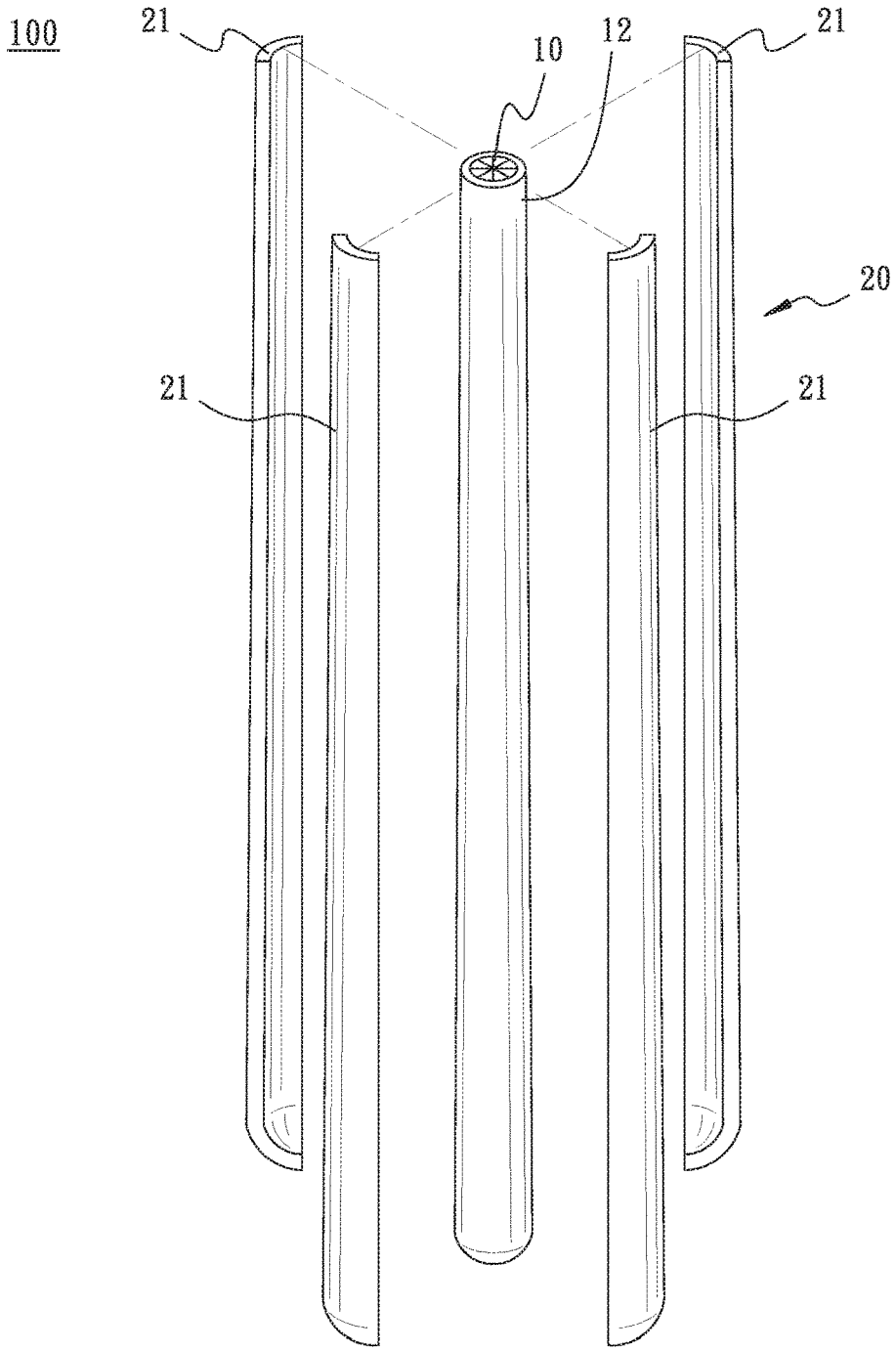
FIG. 13A is an exploded view of the cue butt in accordance with the twelfth embodiment of the present invention.
Figure 13B:
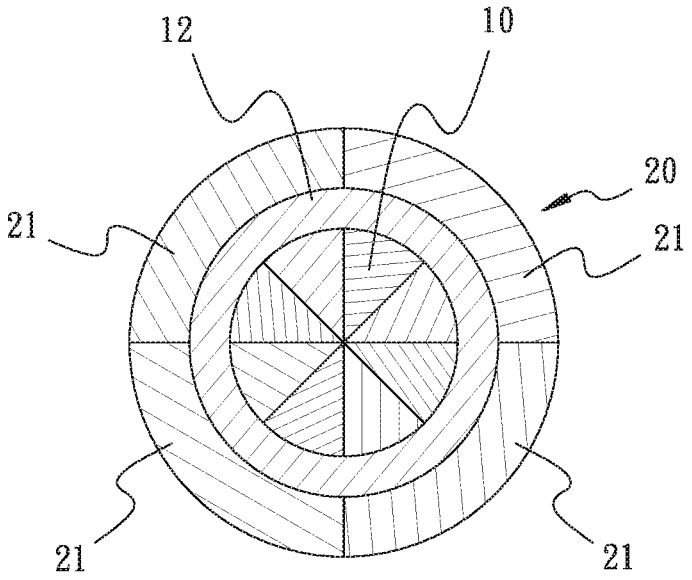
FIG. 13B is a sectional view of the cut butt in accordance with the twelfth embodiment of the present invention.

Referring to FIG. 12A and FIG. 12B, a cue butt 100 with ball control enhancement function in accordance with an eleventh embodiment of the present invention is provided. The core rod 10 is a solid structure having a circular shaped sectional face and formed of a plurality of component members 11, with the hollow member 12 mounted around the outer edge of the core rod 10. The external body 20 includes two casing members 21, whose sectional face is formed in a semi-circular shape. Referring to the twelfth embodiment as shown in FIG. 13A and FIG. 13B, the external body 20 includes four casing members 21.

Figure 14:
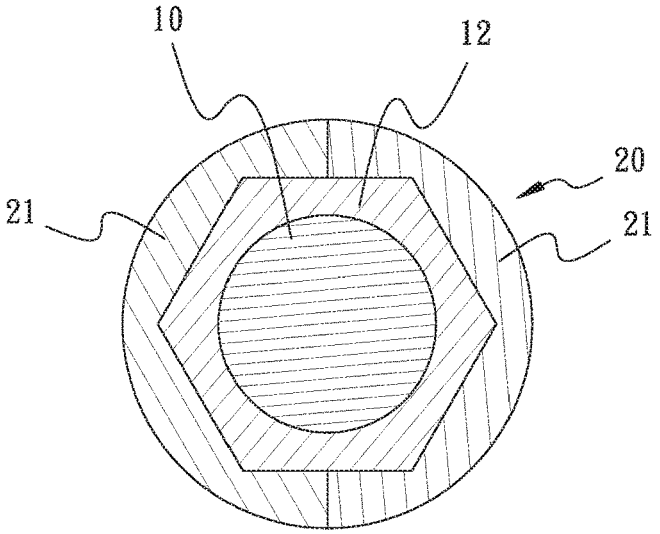
FIG. 14 is a sectional view of the cut butt in accordance with the thirteenth embodiment of the present invention.
Figure 15:
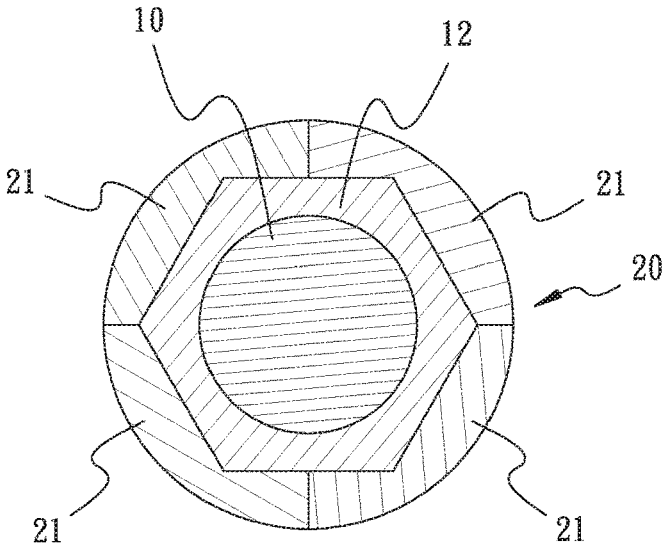
FIG. 15 is a sectional view of the cut butt in accordance with the fourteenth embodiment of the present invention.

Referring to FIG. 14, a cue butt 100 with ball control enhancement function in accordance with an thirteenth embodiment of the present invention is provided. The core rod 10 is a solid structure having a circular shaped sectional face, with the hollow member 12 mounted around the outer edge of the core rod 10. The outer edge of the hollow member 12 is formed in a non-circular shape, such as a hexagonal shape, with the inner edge of the external body 20 formed in a corresponding non-circular shape for facilitating the fitting engagement between the outer edge of the hollow member 12 and the inner edge of the external body 20. Also, the external body 20 includes an even amount of the casing members 21, such as two casing members. Referring to the fourteenth embodiment as shown in FIG. 15, the external body 20 includes four casing members 21.

Figure 16:
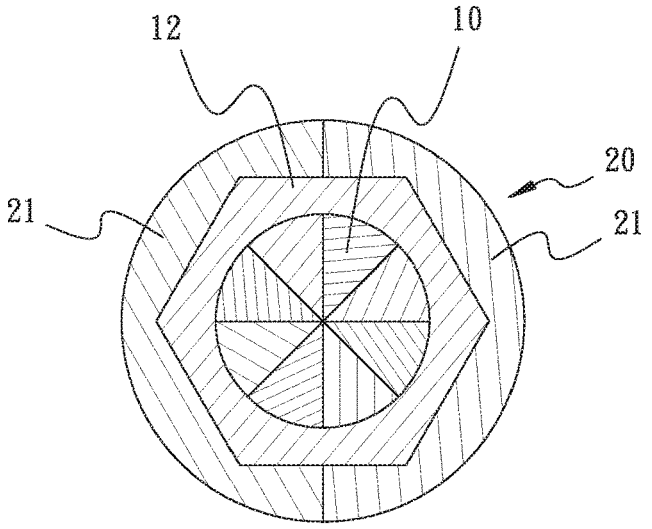
FIG. 16 is a sectional view of the cut butt in accordance with the fifteenth embodiment of the present invention.
Figure 17:
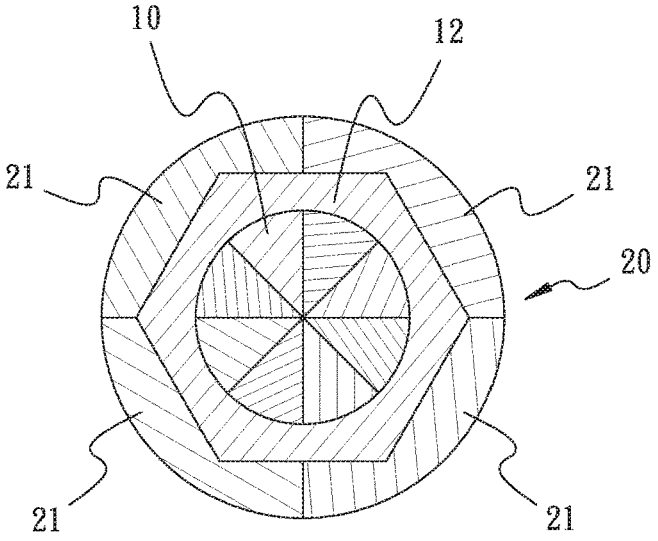
FIG. 17 is a sectional view of the cut butt in accordance with the sixteenth embodiment of the present invention.

Referring to FIG. 16, a cue butt 100 with ball control enhancement function in accordance with an fifteenth embodiment of the present invention is provided. The core rod 10 is a solid structure formed of a plurality of component members 11, with the sectional face of the core rod 10 formed in an approximate circular shape. The hollow member 12 is mounted around the outer edge of the core rod 10. The outer edge of the hollow member 12 is formed in a non-circular shape, with the inner edge of the external body formed in a corresponding non-circular shape for facilitating the fitting engagement between the outer edge of the hollow member 12 and the inner edge of the external body 20. In addition, the external body 20 includes an even amount of the casing members 21, such as two casing members 21. Referring to the sixteenth embodiment as shown in FIG. 17, the external body 20 includes four casing members 21.

Figure 18:
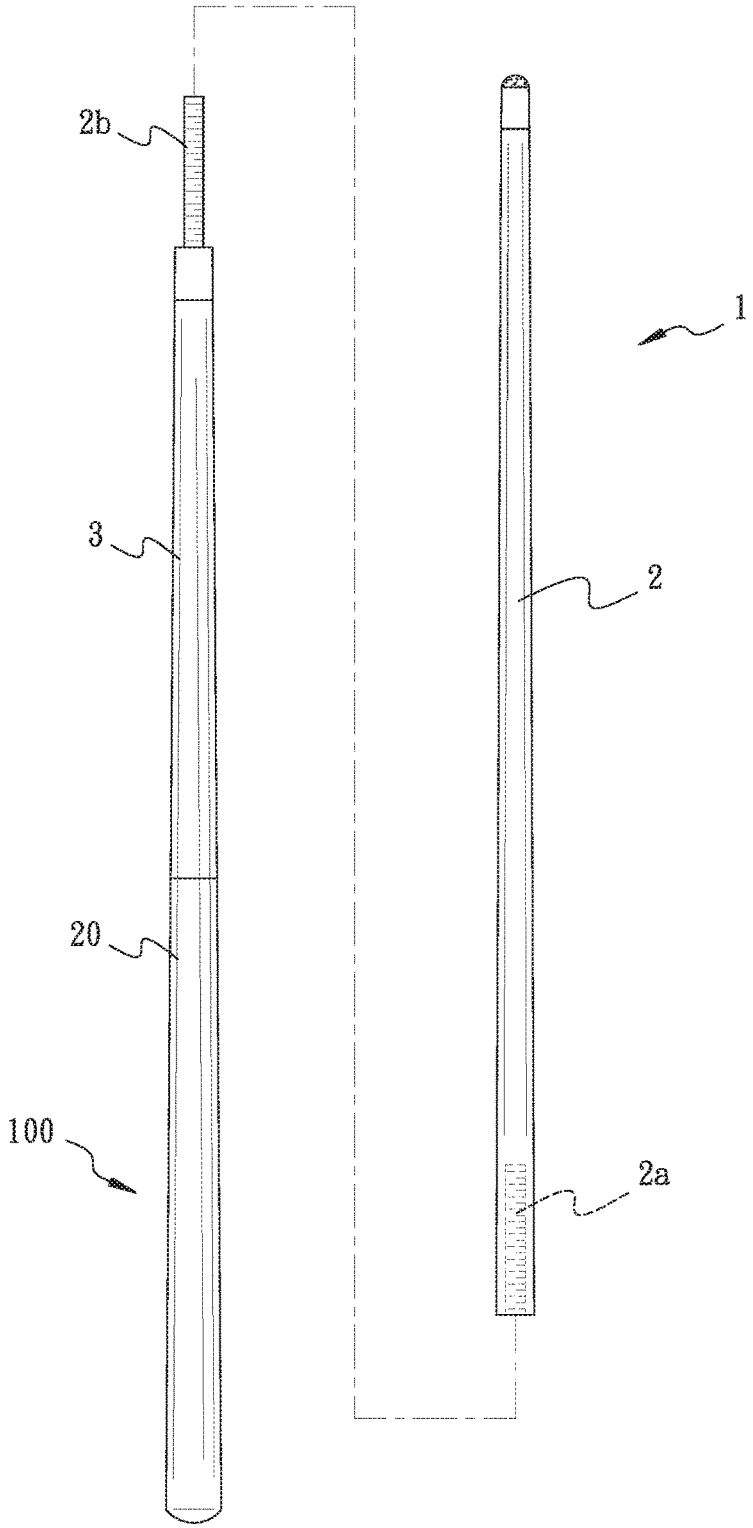
FIG. 18 is a sectional view of the cut butt in accordance with the seventeenth embodiment of the present invention.

Referring to FIG. 18, a cue butt 100 with ball control enhancement function in accordance with an seventeenth embodiment of the present invention is provided. The cue butt 100 further includes an extension rod 3 connected between the cue shaft 2 and the cue butt 100, with the second combination portion 2*b* disposed at one end of the extension rod 3, such that the cue butt 100 is combined with the cue shaft 2 through the extension rod 3.

Figure 19:
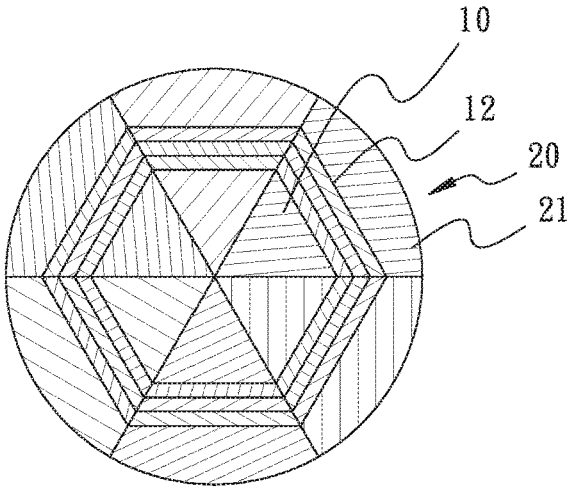
FIG. 19 is a sectional view of the cut butt in accordance with the eighteenth embodiment of the present invention.

Referring to FIG. 19, a cue butt 100 with ball control enhancement function in accordance with an eighteenth embodiment of the present invention is provided. The hollow member 12 disposed between the external body 20 and the core rod 10 is formed of a multi-layer structure. In the embodiment, the hollow member 12 is formed of, but not limited to, three layers. Also, the hollow member 12 is allowed to be chosen from wood, carbon fiber, bakelite material, or combination thereof which has different color. Also, the inner edge of the hollow member 12 and the outer edge of the core rod 10 are formed in a non-circular shape, and the inner edge of the external body 20 and the outer edge of the hollow member 12 are formed in a non-circular shape. Therefore, a combination of a diversity of materials improves the straightness and the cue ball hitting stability.

Figure 20:
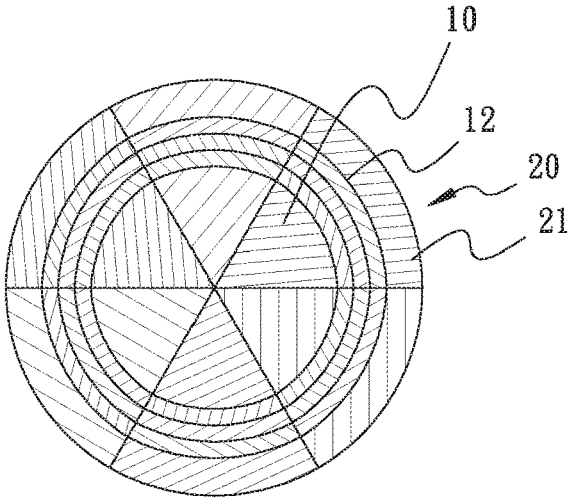
FIG. 20 is a sectional view of the cut butt in accordance with the nineteenth embodiment of the present invention.

Referring to FIG. 20, a cue butt 100 with ball control enhancement function in accordance with an nineteenth embodiment of the present invention is provided. The inner edge of the external body 20, the inner edge and outer edge of the hollow member 12, and the outer edge of the core rod 10 are all formed in a circular shape for facilitating the fitting engagement between the external body 20 and the hollow member 12 and between the hollow member 12 and the core rod 10.

With such configuration, the cue butt 100 of the present invention is formed of a combination structure instead of a singular structure. Therefore, the overall structure and quality of the billiard cue are prevented from effect caused by weather variation. Also, the cue butt is not overly rigid beyond a desired degree, thus improving the ball control stability and achieving an optimal cue ball hitting performance.

Although particular embodiments of the invention have been described in detail for purposes of illustration, various modifications and enhancements may be made without departing from the spirit and scope of the invention.

Accordingly, the invention is not to be limited except as by the appended claims.

What is claimed is:

1. A cue butt with ball control enhancement function, which is combined with a cue shaft of a billiard cue, the cue butt comprising:

a core rod having a first end and a second end, with an outer edge formed along an axial direction between the first end and the second end, the outer edge being formed in a continuous smooth surface without concave and convex structures;

a hollow member seamlessly mounted around the outer edge, the hollow member having a continuous and smooth outer surface without concave and convex structures; and an external body mounted around the outer surface of the hollow member and fully covering the outer surface of the hollow member, wherein the external body includes a plurality of strip shaped casing members disposed around a central axis of the core rod, and each of the casing members has a continuous smooth inner surface without concave and convex structures, such that the inner surfaces are seamlessly attached to the outer surface.

2. The cue butt of claim 1, further comprising an extension rod connected between the cue shaft and the cue butt.

3. The cue butt of claim 2, wherein the core is a solid structure which is allowed to be formed of a singular component member or a plurality of component members.

4. The cue butt of claim 1, wherein the hollow member is a multi-layer structure, and formed of a material selected from a group consisting of wood, carbon fiber, bakelite, and a combination thereof.

5. The cue butt of claim 4, wherein the outer edge of the core rod is allowed to be formed in a circular or non-circular shape, and an inner edge of the hollow member is formed in a corresponding circular or non-circular shape which fits the shape of the outer edge of the core rod; an outer edge of the hollow member is allowed to be formed in a circular or non-circular shape, and an inner edge of the external body is formed in a corresponding circular or non-circular shape which fits the shape of the outer edge of the hollow member.

6. The cue butt of claim 1, wherein the external body includes an even amount of the casing members.

7. A billiard cue comprising a cue shaft and a cue butt combined with the cue shaft, the cue butt comprising:

a core rod having a first end and a second end, with an outer edge formed along an axial direction between the first end and the second end, the outer edge being formed in a continuous smooth surface without concave and convex structures;

a hollow member seamlessly mounted around the outer edge, the hollow member having a continuous and smooth outer surface without concave and convex structures; and an external body mounted around the outer surface of the hollow member and fully covering the outer surface of the hollow member, the external body including a plurality of strip shaped casing members disposed around a central axis of the core rod, wherein each of the casing members has a continuous smooth inner surface without concave and convex structures, such that the inner surfaces are seamlessly attached to the outer surface, and wherein the cue shaft includes a first combination portion, and the cue butt includes a second combination portion, such that the first combination portion and the second combination portion are combined through a concave-convex structure.

8. The billiard cue of claim 7, wherein the first combination portion and the second combination portion are screwedly combined.

9. The billiard cue of claim 8, further comprising an extension rod connected between the cue shaft and the cue butt.

* * * * *